US011499207B2

(12) United States Patent
Kakitani et al.

(10) Patent No.: US 11,499,207 B2
(45) Date of Patent: Nov. 15, 2022

(54) COPPER ALLOY STRIP EXHIBITING IMPROVED DIMENSIONAL ACCURACY AFTER PRESS-WORKING

(71) Applicant: JX Nippon Mining & Metals Corporation, Tokyo (JP)

(72) Inventors: Akihiro Kakitani, Kanagawa (JP); Hironori Imamura, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 0 days.

(21) Appl. No.: 16/496,269

(22) PCT Filed: Mar. 20, 2018

(86) PCT No.: PCT/JP2018/011147
§ 371 (c)(1),
(2) Date: Sep. 20, 2019

(87) PCT Pub. No.: WO2018/174081
PCT Pub. Date: Sep. 27, 2018

(65) Prior Publication Data

US 2020/0032374 A1 Jan. 30, 2020

(30) Foreign Application Priority Data

Mar. 22, 2017 (JP) ..... JP2017-056487

(51) Int. Cl.
*C22C 9/06* (2006.01)
*C22F 1/08* (2006.01)

(52) U.S. Cl.
CPC . *C22C 9/06* (2013.01); *C22F 1/08* (2013.01)

(58) Field of Classification Search
CPC ..... C22C 9/06; C22F 1/08; H01B 1/026
See application file for complete search history.

(56) References Cited

U.S. PATENT DOCUMENTS

2010/0269959 A1 10/2010 Gao et al.
2011/0073221 A1 3/2011 Kaneko et al.
2012/0241056 A1 9/2012 Sato et al.

FOREIGN PATENT DOCUMENTS

CN 104805484 A * 7/2015
JP 2006283059 A 10/2006
(Continued)

OTHER PUBLICATIONS

JP-2015086416-A English translation from EPO, Hatano Takaaki, 2015 (Year: 2015).*

(Continued)

*Primary Examiner* — Anthony J Zimmer
*Assistant Examiner* — Jacob J Gusewelle
(74) *Attorney, Agent, or Firm* — Faegre Drinker Biddle & Reath LLP

(57) ABSTRACT

Provided is a Corson alloy having improved bending workability and also having high dimensional accuracy after press-working. A copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material has a surface satisfying the relationship: $1.0 \leq I_{(200)}/I_{0(200)} \leq 5.0$; wherein an area ratio of Cube orientation {100} <001> is from 2 to 10% in EBSD measurement of a rolling parallel cross section; and wherein a ratio: (an average crystal grain size of Cube orientation {100} <001> of the rolling parallel cross section)/(an average crystal grain size of the rolling parallel cross section) is from 0.75 to 1.5.

7 Claims, 1 Drawing Sheet

(56) References Cited

FOREIGN PATENT DOCUMENTS

| | | | | |
|---|---|---|---|---|
| JP | 2010275622 | A | | 12/2010 |
| JP | 201112321 | A | | 1/2011 |
| JP | 201117072 | A | | 1/2011 |
| JP | 4857395 | B1 | | 1/2012 |
| JP | 2012177152 | A | | 9/2012 |
| JP | 2012246549 | A | | 12/2012 |
| JP | 2013163853 | A | | 8/2013 |
| JP | 2013227642 | A | | 11/2013 |
| JP | 2015086416 | A | * | 5/2015 |
| JP | 2015086416 | A | | 5/2015 |
| WO | 2009148101 | A1 | | 12/2009 |
| WO | 2011068121 | A1 | | 6/2011 |
| WO | 2011068134 | A1 | | 6/2011 |
| WO | WO-2012029717 | A1 | * | 3/2012 ..... C22C 9/00 |
| WO | 2012160726 | A1 | | 11/2012 |
| WO | 2013145824 | A1 | | 10/2013 |
| WO | 2015146981 | A1 | | 10/2015 |

OTHER PUBLICATIONS

WO-2012029717-A1 English translation from EPO, Eguchi Tatsuhiko; Isomatsu Takeki; Kaneko Hiroshi, 2012 (Year: 2012).*

International Preliminary Report on Patentability for PCT/JP2018/011147, dated Oct. 3, 2019, 6 pages.

WIPO International Search Report for PCT/JP2018/011147 dated May 22, 2018, 4 pages.

Extended European Search Report of EP18771999.2 related to PCT/JP2018/011147 dated Oct. 1, 2020, 7 pages.

* cited by examiner

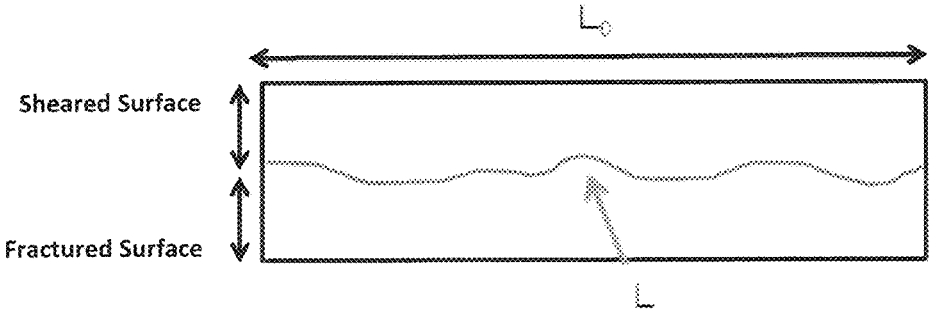
$L_0$
Sheared Surface
Fractured Surface
L

COPPER ALLOY STRIP EXHIBITING IMPROVED DIMENSIONAL ACCURACY AFTER PRESS-WORKING

TECHNICAL FIELD

The present invention relates to a copper alloy strip. More particularly, the present invention relates to a Corson alloy strip having improved strength, bending workability, stress relaxation resistance, conductivity and the like, which is suitable as a conductive spring material such as a connector, a terminal, a relay, and a switch, and as a lead frame material for semiconductor devices, such as a transistor and an integrated circuit (IC).

BACKGROUND ART

Recently, miniaturization of electric and electronic parts has progressed, and copper alloys used for these parts have been required to have good strength, conductivity and bending workability. In response to the requirement, a demand for precipitation-hardening copper alloys such as Corson alloys having high strength and conductivity has been increased in place of conventional solid solution-hardening copper alloys such as phosphor bronze and brass.

The Corson alloy has intermetallic compounds such as Ni—Si, Co—Si, and Ni—Co—Si precipitated in a Cu matrix, and also has high strength, high conductivity, and good bending workability. In general, the strength and the bending workability are properties contrary to each other, and the Corson alloy is also desired to improve the bending workability while maintaining high strength. Here, the Corson alloy has properties in which a bending workability where a bending axis is perpendicular to a rolling direction (Good Way) is poor as compared with a bending workability where the bending axis is parallel to the rolling direction (Bad Way). Therefore, in particular, there is a need for improvement of the Good Way bending workability.

Recently, as a technique for improving the bending workability of Corson alloys, an approach for developing a {001} <100> orientation (Cube orientation) has been proposed. For example, Patent Document 1 (Japanese Patent Application Publication No. 2006-283059 A) discloses that an area ratio of the cube orientation is controlled to 50% or less to improve the bending workability by carrying out the steps of (1) casting, (2) hot rolling, (3) cold rolling (at a working ratio of 95% or more), (4) solutionizing treatment, (5) cold rolling (at a working ratio of 20% or less), (6) aging treatment, (7) cold rolling (at a working ratio of from 1 to 20%), and (8) short-time annealing in this order.

Patent Document 2 (Japanese Patent Application Publication No. 2010-275622 A) discloses that an X-ray diffraction intensity of (200) (which has the same meaning as {100}) is controlled to be equal or more than an X-ray diffraction intensity of a copper powder standard sample to improve the bending workability by carrying out the steps of (1) casting, (2) hot rolling (performed while decreasing a temperature from 950° C. to 400° C.), (3) cold rolling (a rolling rate of 50% or more), (4) intermediate annealing (450 to 600° C.; adjusting the conductivity to 1.5 times or more and adjusting the hardness to 0.8 times or less), (5) cold rolling (at a rolling rate of 70% or more), (6) solutionizing treatment, (7) cold rolling (a rolling rate of from 0 to 50%), and (8) aging treatment in this order.

Patent Document 3 (Japanese Patent Application Publication No. 2011-17072 A) controls an area ratio of Cube orientation to 5 to 60%, while at the same time controlling each of area ratios of Brass orientation and Copper orientation to 20% or less, to improve the bending workability. The best bending workability is obtained when the following steps are sequentially carried out: (1) casting, (2) hot rolling, (3) cold rolling (at a working ratio of from 85 to 99%), (4) heating treatment (at 300 to 700° C. for 5 minutes to 20 hours), (5) cold rolling (at a working ratio of from 5 to 35%), (6) solutionizing treatment (a heating rate of from 2 to 50° C./sec), (7) aging treatment, (8) cold rolling (at a working ratio of from 2 to 30%), and (9) temper annealing.

Patent Document 4 (Japanese Patent No. 4857395 B) controls an area ratio of Cube orientation to 10 to 80%, and each of area ratios of Brass orientation and Copper orientation to 20% or less, at a central portion in a thickness direction, to improve the notch bendability. It also discloses, as a production method for enabling notch bending, the following steps: (1) casting, (2) hot rolling, (3) cold rolling (at a working ratio of 99%), (4) pre-annealing (at a softening degree of from 0.25 to 0.75; conductivity of from 20 to 45% IACS), (5) cold rolling (from 7 to 50%), (6) solutionizing treatment, and (7) aging.

Patent Document 5 (WO 2011/068121 A1) improves 180° tight bending property and stress relaxation resistance by controlling a ratio W0/W4 to 0.8 to 1.5 and W0 to 5 to 48% in which W0 is an area ratio of Cube orientation at a surface layer of a material and W4 is an area ratio of the Cube orientation at a ¼ position of the total depth of the material, and further adjusting an average grain size to 12 to 100 μm. It also discloses, as the production method, the following steps: (1) casting, (2) hot rolling (at a working ratio per pass of 30% or less, for a retention time period between the respective passes of 20 to 100 seconds), (3) cold rolling (at a working ratio of 90 to 99%), (4) heat treatment (at 300 to 700° C. for 10 seconds to 5 hours), (5) cold rolling (at a working ratio of 5 to 50%), (6) solutionizing treatment (at 800 to 1000° C.), (7) aging treatment, (8) cold rolling, and (9) temper annealing.

Although not technique for improve bending workability, Patent Document 6 (WO 2011/068134) adjusts a Young's modulus to 110 GPa or less and a bending deflection coefficient to 30% or more by controlling an area ratio of a (100) plane facing a rolling direction to 30% or more. It also discloses, as the production method, the following steps: (1) casting, (2) hot rolling (slow cooling), (3) cold rolling (at a rolling rate of 70% or more), (4) heat treatment (at 300 to 800° C. for 5 seconds to 2 hours), (5) cold rolling (at a rolling rate of 3 to 60%), (6) solutionizing treatment, (7) aging treatment, (8) cold rolling (at a rolling rate of 50% or less), and (9) temper annealing.

Patent Document 7 (Japanese Patent Application Publication No. 2012-177152 A) improve bending workability and stress relaxation resistance by having an average grain size of crystal grains of a copper alloy of from 5 to 30 μm, having an area occupied by crystal grains with a crystal grain size twice the average grain size of 3% or more, and having, among those crystal grains, an area ratio occupied by Cube orientation of 50% or more.

Patent Document 8 (Japanese Patent Application Publication No. 2013-227642 A) discloses that a relationship: $I_{(200)}/I_{0(200)} \geq 1.0$ is satisfied on a surface, and a relationship: $I_{(220)}/I_{0(220)}+I_{(311)}/I_{0(311)} \geq 1.0$ is satisfied in a cross section with a depth of from 45 to 55% relative to a plate thickness, whereby a Young's modulus in a rolling perpendicular direction is controlled while improving bendability.

CITATION LIST

Patent Literatures

Patent Document 1: Japanese Patent Application Publication No. 2006-283059 A
Patent Document 2: Japanese Patent Application Publication No. 2010-275622 A
Patent Document 3: Japanese Patent Application Publication No. 2011-17072 A
Patent Document 4: Japanese Patent No. 4857395 B
Patent Document 5: WO 2011/068121 A1
Patent Document 6: WO 2011/068134 A1
Patent Document 7: Japanese Patent Application Publication No. 2012-177152 A
Patent Document 8: Japanese Patent Application Publication No. 2013-227642 A

SUMMARY OF INVENTION

Technical Problem

However, recently, miniaturization of connectors has promoted narrowing of a pitch (a distance between pins) of a multi-pin type connector produced by continuous pressing. In Corson alloys in which Cube orientation has been developed according to the prior art to improve the bendability, Young's modulus, stress relaxation characteristics, and the like for those small connectors, the pitch after pressing significantly varies, resulting in poor dimensional accuracy after press punching or subsequent bending, and poor product yield due to dimensional defects. In particular, as disclosed in Patent Document 7, it has been found that dispersion of measurable coarse Cube orientation grains extremely deteriorates dimensional accuracy after press-working.

Therefore, the present inventors have studied improvement of dimensional accuracy after press-working by controlling the area ratio of Cube orientation grains and the grain size of Cube orientation grains. As a result, the present inventors have found that since a difference is generated in formed conditions of the press fracture surface during pressing between the Cube orientation grains and other crystal grains, the press fracture surface is not stable and the dimensional accuracy of the pin affected by the residual stress is poor.

Thus, an object of the present invention is to provide a Corson alloy having improved bending workability and also having high dimensional accuracy after press-working.

Solution to Problem

As a result of intensive studies, the present inventors have found a Corson alloy having good dimensional accuracy after press-working (hereinafter referred to as a "press property") while having good bending workability and a method for producing the same, by analyzing a crystal orientation of a Corson alloy by X-ray diffraction method, and optimizing an area ratio of Cube orientation grains, a size of Cube orientation grains and a size of Cube orientation grains relative to the whole average grain size for the crystal orientation of a rolling parallel cross section using a SEM-EBSD method.

In one aspect, the present invention completed on the basis of the above findings provides a copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material has a surface satisfying the relationship: $1.0 \leq I_{(200)}/I_{0(200)} \leq 5.0$; wherein an area ratio of Cube orientation {100} <001> is from 2 to 10% in EBSD measurement of a rolling parallel cross section; and wherein a ratio: (an average crystal grain size of Cube orientation {100} <001> of the rolling parallel cross section)/(an average crystal grain size of the rolling parallel cross section) is from 0.75 to 1.5.

In one embodiment of the copper alloy strip, the average crystal grain size of {100} <001> of the rolling parallel cross section is from 2 to 20 μm.

In another embodiment, the copper alloy strip contains one or more of Sn, Zn, Mg, Cr and Mn in a total amount of from 0.005 to 2.0% by mass.

Advantageous Effects of Invention

According to the present invention, it is possible to provide a Corson alloy having an improved bending workability as well as a good pressing property.

BRIEF DESCRIPTION OF DRAWINGS

FIG. 1 is a schematic view illustrating a fractured surface and a sheared surface formed on a press-fractured surface in evaluation of a pressing property in Examples.

DESCRIPTION OF EMBODIMENTS

Hereinafter, a copper alloy plate according to an embodiment of the present invention will be described. It should be noted that in the present invention, "%" indicates % by mass unless otherwise specified.

(Composition of Alloy)

(Added Amount of Ni, Co and Si)

Ni and Si are precipitated as intermetallic compounds such as Ni—Si and Ni—Si—Co by performing an appropriate aging treatment. The action of the precipitates improves the strength, and the precipitation decreases Ni, Co and Si dissolved in the Cu matrix to improve the conductivity. However, when the amount of Ni+Co is less than 0.2% by mass, any desired strength cannot be obtained. Conversely, when the amount of Ni+Co is more than 5.0% by mass, the bending workability is significantly deteriorated. Therefore, in the Corson alloy according to the present invention, preferably, the amount of Ni added is from 0 to 5.0% by mass, the amount of Co added is from 0 to 2.5% by mass, and the amount of Ni+Co is from 0.2 to 5.0% by mass. The amount of Si added is from 0.2 to 1.5% by mass. The amount of Ni added is more preferably from 1.0 to 4.8% by mass, the amount of Co added is more preferably 0 to 2.0% by mass, and the amount of Si added is more preferably from 0.25 to 1.3% by mass.

(Other Added Elements)

Sn, Zn, Mg, Cr, and Mn contribute to an increase in strength. Zn is effective for improving thermal peeling resistance of Sn plating, Mg is effective for improving stress relaxation characteristics, and Cr and Mn are effective for improving hot workability. If the total amount of Sn, Zn, Mg, Cr and Mn is less than 0.005% by mass, the above effect cannot be obtained, and if it is more than 1.0% by mass, the bending workability is significantly reduced. Therefore, the Corson alloy according to the present invention preferably contains these elements in a total amount of from 0.005 to 2.0% by mass, and more preferably from 0.01 to 1.5% by mass, and even more preferably from 0.01 to 1.0% by mass.

(Crystal Orientation)

In the present invention, measurement of θ/2θ is carried out on a plate surface of a rolled material sample by an X-ray diffraction method to measure an integrated intensity ($I_{(hkl)}$) of a diffraction peak of a certain orientation (hkl) plane. At the same time, an integrated intensity ($I_{0(hkl)}$) of the diffraction peak of the (hkl) plane is also measured for copper powder as a randomly oriented sample. Then, using the value of $I_{(hkl)}/I_{0(hkl)}$, a degree of development of the (hkl) plane on the plate surface of the rolled material sample is evaluated. In order to obtain good pressing property, the ratio $I_{(200)}/I_{0(200)}$ on the surface of the rolled material is adjusted. Cube orientation can be said to be more developed as the ratio $I_{(200)}/I_{0(200)}$ is higher. When the ratio $I_{(200)}/I_{0(200)}$ is controlled to 0.5 or more, preferably 1.0 or more, the pressing property is improved. On the other hand, although the upper limit of the ratio $I_{(200)}/I_{0(200)}$ is not limited in terms of improvement of the bending workability, if the ratio $I_{(200)}/I_{0(200)}$ is too high, the pressing property is deteriorated. Therefore, the ratio $I_{(200)}/I_{0(200)}$ is 5.0 or less, or further 4.0 or less.

(Area Ratio of Cube Orientation Grain and Crystal Grain Size of Cube Orientation Grain)

The area ratio of crystal grains and the crystal grain size from the rolling parallel cross section are important for the pressing property. In this embodiment, using a crystal orientation analysis method with an apparatus providing an electron field emission type scanning electron microscope with an electron back scattering pattern (EBSP) system, an area ratio of Cube orientation grains in the rolling parallel cross section, and an average crystal grain size of the Cube orientation grains and an average crystal grain size of the whole grains including the Cube orientation grains of the rolling parallel cross section are measured.

In the present embodiment, the area ratio of Cube orientation is from 2 to 10%, and more preferably from 2.5 to 8%, and still more preferably from 3 to 7%. If the area ratio of Cube orientation is more than 10%, the pressing property may be deteriorated. If the area ratio of Cube orientation is less than 2.0%, the bending workability may be deteriorated.

An average crystal grain size of the grain sizes in the Cube orientation is from 2 to 20 μm, and more preferably from 3 to 18 μm, and still more preferably from 3 to 15%. If the average grain size in the Cube orientation is more than 20 μm, the pressing property may be deteriorated, and if it is less than 2 μm, the bending improvement effect may not be obtained.

A ratio of the average crystal grain size in Cube orientation to the average crystal grain size on the rolling parallel cross section (the average crystal grain size in Cube orientation {100} <001> on the rolling parallel cross section)/(the average grain size on the rolling parallel cross section) is from 0.75 to 1.5, and more preferably from 0.8 to 1.4, and still more preferably from 0.9 to 1.3. If the ratio of the average grain sizes is more than the range of from 0.75 to 1.5, the pressing property may be deteriorated.

It should be understood that in the measurement of Cube orientation according to the present invention, an orientation deviation within ±10° from the crystal plane belongs to the same orientation. It also should be understood that a boundary of crystal grains having an orientation difference of 5° or more between adjacent crystal grains is defined as a grain boundary.

Moreover, a crystal orientation distribution of the rolling parallel cross section is important in the present invention. Therefore, if the plate thickness is 0.08 mm, a measuring area with 100 μm (the plate thickness plus 20 μm is a standard)×500 μm is irradiated with an electron beam at a pitch of 0.5 μm, and an average crystal grain size is calculated by (ΣX/n), where n is the number of crystal grains measured by the crystal orientation analysis method and X is a crystal grain size measured for each crystal grain. The measuring area may be optionally adjusted such that the entire plate thickness is included. As described above, the average crystal grain size of Cube orientation grains and the average crystal grain size in the plate thickness direction are calculated.

(Pressing Property)

Dimensional accuracy after pressing should be generally evaluated after pressing a narrow pitch connector using an industrial facility. The pressing property (dimensional accuracy after pressing) is evaluated by carrying out a simple punching test to observe press fracture surfaces. In the present embodiment, a material is pressed using square punches each having one side of 10 mm and a clearance of 0.005 mm and dies, and the press fractured surfaces are observed. Furthermore, a mold with a movable stripper capable of fixing the material during pressing was used. When evaluating samples with different thicknesses, they are adjusted such that the clearance/thickness is in a range of from 5 to 8.5%.

(Production Method)

In a general process for producing a Corson alloy, first, raw materials such as electric copper, Ni, Co, Si and the like are melted in a melting furnace to obtain a molten metal having a desired composition. The molten metal is then cast into an ingot. It is then subjected to hot rolling, cold rolling, solutionizing treatment and aging treatment in this order and finished into a strip or foil having a desired thickness and characteristics. After the heat treatment, the surface may be subjected to washing with an acid, polishing or the like, in order to remove a surface oxide film generated during the heat treatment. Further, cold rolling may be performed between the solutionizing treatment and the aging or after the aging, in order to increase the strength.

In the present invention, a heat treatment (hereinafter also called pre-annealing) and cold rolling at a relatively low working ratio (hereinafter also called light rolling) are carried out before the solutionizing treatment in order to obtain the above crystal orientation. These steps are the same as the production steps disclosed in Patent Document 4. In the present invention, the rolled surface roughness during the pre-annealing and solutionizing treatment, and a temperature rising rate of the solutionizing treatment are further controlled.

The pre-annealing is carried out for the purpose of partially forming recrystallized grains in a rolled structure formed by cold rolling after hot rolling. The proportion of recrystallized grains in the rolled structure has an optimum value, and an excessively low or high optimum value cannot provide the crystal orientation as described above. The optimum proportion of recrystallized grains is obtained by adjusting the pre-annealing conditions such that a degree of softening S as defined below is from 0.20 to 0.80, and more preferably from 0.25 to 0.75.

The degree of softening S in the pre-annealing is defined by the following equation:

$$S=(\sigma_0-\sigma)/(\sigma_0-\sigma_{950}),$$ in which:

$\sigma_0$ is a tensile strength before annealing, and $\sigma$ and $\sigma_{950}$ are tensile strengths after pre-annealing and after annealing at 950° C., respectively. The temperature of 950° C. is adopted as a reference temperature for knowing the tensile strength after recrystallization, because the alloy according to the present invention is stably and completely recrystallized when annealed at 950° C.

If the degree of softening is out of the range of from 0.20 to 0.80, accumulation of Cube orientation will become low. The temperature and duration time of the pre-annealing are not particularly limited, and it is important to adjust S to the above range. In general, the pre-annealing is carried out at a furnace temperature of from 400 to 750° C. for 5 seconds to 10 minutes when using a continuous annealing furnace, and at a furnace temperature of 350 to 600° C. for 30 minutes to 20 hours when using a batch annealing furnace.

After the above pre-annealing and prior to the solutionizing treatment, light rolling is carried out at a working ratio of from 3 to 50%, and more preferably from 7 to 45%. The working ratio R (%) is defined by the following equation:

$$R=(t_0-t)/t_0\times 100$$ ($t_0$: a thickness before rolling, $t$: a thickness after rolling)

If the working ratio is out of the range of from 3 to 50%, the ratio $I_{(200)}/I_{0(200)}$ will be less than 1.0 on the surface of the rolled material, so that the bending workability is deteriorated.

Further, an arithmetic average roughness Ra of the surface of the material after the above light rolling is ≥0.15 μm. The arithmetic average roughness Ra is a roughness of the surface of the material after the light rolling, which is determined based on JIS B0601 (2001). To achieve such an arithmetic average roughness Ra, a roll surface during light rolling can be improved.

If the arithmetic average roughness is less than 0.15 μm, the average crystal grain size of the Cube orientation grains will be increased, and the ratio of the average crystal grain size of the Cube grains/the average grain size will be equal to or more than 1.5, so that the pressing property is deteriorated. If the arithmetic average roughness is higher than 0.4 μm, the area ratio of Cube oriented grains will be 10% or less, so that the pressing property is deteriorated. For the surface roughness of the material, the roughness of the work roll is changed during the light rolling, but mechanical polishing or the like may be performed after rolling.

After performing the light rolling, the solutionizing is carried out in a material temperature range of from 700 to 900° C. at a temperature rising rate of from 10 to 30° C./sec. If the temperature rise rate is less than 10° C./sec, the Cube orientation grains grow to increase the average crystal grain size of Cube to be larger than 20 μm, and the area ratio of Cube orientation grains will be equal to or less than 10%, so that the pressing property is deteriorated. If the temperature rising rate is 30° C./sec or more, the ratio of the average crystal grain size/the average crystal grain size of Cube grains will be less than 0.75, so that the pressing property is deteriorated. If the solutionizing temperature is less than 700° C., a part of the material will become non-recrystallized after the solutionizing, so that the pressing property is deteriorated. On the other hand, If the solutionizing temperature is 900° C. or more, the ratio $I_{(200)}/I_{0(200)}$ will be 5.0 or more, so that the pressing property is deteriorated.

Thus, the steps of the production method for the copper alloy strip according the embodiment of the present application are listed according the step order, as follows:

(1) casting of an ingot (having a thickness of from 20 to 300 mm);

(2) hot rolling (at a temperature of from 800 to 1000° C.; a thickness of from 3 to 20 mm);

(3) cold rolling (at a working ratio of from 80 to 99.8%)

(4) pre-annealing (at a degree of softening: S=0.20 to 0.80)

(5) light rolling (at a working ratio of from 3 to 50%; and an arithmetic average roughness Ra≥0.15 μm);

(6) solutionizing treatment (at a temperature of from 700 to 900° C. and at a temperature rising rate of from 10 to 30° C./sec);

(7) cold rolling (at a working ratio of from 0 to 50%);

(8) aging treatment (at a temperature of from 350 to 600° C. for 2 to 20 hours);

(9) cold rolling (at a working ratio of from 0 to 50%); and

(10) strain relief annealing (at a temperature of from 300 to 700° C. for 5 seconds to 10 hours).

The cold rolling steps (7) and (9) are optionally carried out to increase the strength. However, these steps increase the strength with an increase in the rolling working ratio, but they tend to decrease the ratio $I_{(200)}/I_{0(200)}$ on the surface. Therefore, if the working ratio of cold rolling (7) and (9) is more than 50% in total, the ratio $I_{(200)}/I_{0(200)}$ on the surface will be less than 1.0, so that the bending workability is deteriorated.

The strain relief annealing (10) is optionally performed to recover a spring limit value or the like which would otherwise be decreased by the cold rolling when the cold rolling (9) is performed. Regardless of the presence or absence of strain relief annealing (10), the effect of the present invention is obtained which achieve both of good bending workability and good pressing property by controlling the crystal orientation. The strain relief annealing (10) may or may not be performed.

In addition, for the steps (2), (3), (8) and (10), general producing conditions for Corson alloys may be selected.

(Application)

The Corson alloy according to the present invention can be processed into various copper rolled products such as plates, strips and foils. Further, the Corson alloy according to the present invention can be used for electric device parts such as lead frames, connectors, pins, terminals, relays, switches, foil materials for secondary batteries and the like. In particular, the Corson alloy according to the present invention is suitable as a part that is subjected to severe Good Way bending.

EXAMPLES

Examples of the present invention are given below, but these Examples are provided for better understanding of the present invention and its advantages, and are not intended to limit the present invention.

Example 1

An alloy containing 2.6% by mass of Ni, 0.58% by mass of Si, 0.5% by mass of Sn and 0.4% by mass of Zn, the balance being copper and unavoidable impurities, was used as an experimental material. The experimental material was subjected to studies for a relationship between pre-annealing conditions, light rolling conditions and rolling conditions before pre-annealing and the crystal orientation, and further effects of the crystal orientation on the bending workability and mechanical properties of the product.

2.5 kg of electric copper was melted in a high frequency melting furnace in an argon atmosphere using a graphite crucible having an inner diameter of 60 mm and a depth of 200 mm. Alloy elements were added to obtain the above alloy composition and a temperature of the molten metal was adjusted to 1300° C., and the molten metal was then cast in a cast iron mold to produce an ingot having a thickness of 30 mm, a width of 60 mm and a length of 120 mm. The ingot was processed in the following step order to produce a product sample having a plate thickness of 0.08 mm.

(1) Hot Rolling: The ingot heated at 950° C. for 3 hours was rolled up to 10 mm. The material after rolling was immediately cooled in water.

(2) Grinding: Oxide scales produced by hot rolling was removed by a grinder. A grinding amount was 0.5 mm per one side face.

(3) Cold Rolling: The cold rolling was performed to a predetermined thickness.

(4) Pre-annealing: A sample was inserted into an electric furnace adjusted at a certain temperature and maintained for a certain period of time, and the sample was then placed in a water tank to cool it.

(5) Light Rolling: Cold Rolling was carried out at various working ratios. The surface roughness of the material after the light rolling was obtained by adjusting the surface roughness of the work roll during the cold rolling.

(6) Solutionizing Treatment: The sample and thermocouple were inserted into the electric furnace adjusted to 750 to 1200° C., and a temperature of the material was measured with the thermocouple, and the material was removed from the furnace at the time when the temperature of the material reached 700 to 900° C., and cooled by placing it in a water tank. The temperature rising rate (° C./sec) was determined from the material temperature measured by the thermocouples and the arrival time.

(7) Aging Treatment: The material was heated in an Ar atmosphere at 450° C. for 5 hours using an electric furnace.

(8) Cold Rolling: The cold rolling was performed at a working ratio of 20%.

(9) Strain Relief Annealing: The sample was inserted into an electric furnace adjusted to 400° C. and maintained for 10 seconds, and the sample was then left in the ambient air and cooled.

The following evaluation was carried out for a sample after the pre-annealing and a product sample (in this case, after the strain relief annealing).

(Evaluation of Degree of Softening in Pre-Annealing)

Tensile strengths of samples before and after the pre-annealing were measured in parallel to the rolling direction according to JIS Z 2241 using a tensile tester, and the resulting values were defined as Go and a, respectively. Further, a sample annealed at 950° C. was prepared with the above procedure (the sample was inserted into a furnace at 1000° C. and cooled in water when the sample reached 950° C.), and the tensile strength was similarly measured in parallel to the rolling direction to determine $\sigma_{950}$. The degree of softening S was determined from $\sigma_0$, $\sigma$, and $\sigma_{950}$.

$$S=(\sigma_0-\sigma)/(\sigma_0-\sigma_{950})$$

In addition, the sample for the tensile test was the No. 13B sample defined in JIS Z 2201.

(X-Ray Diffraction of Product)

An X-ray diffraction integrated intensity of a (200) plane was measured for the surface of the product sample. Furthermore, an X-ray diffraction integrated intensity of the (200) plane was measured for copper powder (copper (powder), 2N5, >99.5%, 325 mesh, available from Kanto Chemical Co., Ltd.).

The measurement was carried out at a tube voltage of 25 kV and at a tube current of 20 mA in a Cu tube using RINT 2500 from Rigaku Corporation as an X-ray diffractometer.

(Measurement of Crystal Orientation of Product)

In the rolling parallel cross section, the area ratio in {100} <001> orientation was measured. The sample was embedded in a resin, and the rolling parallel cross section was mechanically polished and then finished to have a mirror surface by electrolytic polishing. The EBSD measurement was carried out so as to measure the entire plate thickness; for example, if the plate thickness was 0.08 mm, a measuring area having 100 μm (a plate thickness plus 20 μm was a standard)×500 μm was irradiated with an electron beam at a pitch of 0.5 μm, and a distribution of crystal orientation was measured. A crystal orientation density functional analysis was then performed to obtain an area of a region having an orientation difference within 10° from the {100} <001> orientation, and the area was divided by the total measuring area to provide "an area ratio of crystals oriented to Cube orientation {001} <100>. Further, the number of crystal grains measured by the crystal orientation analysis method was defined as n, and the crystal grain size of each of n crystal grains was defined as X, and an average crystal grain size was calculated by ($\Sigma X/n$). The average crystal grain size of Cube orientation grains and the average grain size of all crystal grains including the Cube orientation grains were calculated according to the above measurement method.

(Tensile Test of Product)

A sample No. 13B defined in JIS Z 2201 was taken such that a tensile direction was parallel to the rolling direction, and subjected to a tensile test in a parallel to the rolling direction according to JIS Z 2241 to obtain tensile strength.

(W Bending Test of Product)

In accordance with JIS H3100, an inner bending radius was defined as t (thickness), and a W bending test was conducted in Good Way direction (a direction where the bending axis was orthogonal to the rolling direction). The bent cross section was finished to have a mirror surface by mechanical polishing and buffing, and the presence or absence of cracking was observed by an optical microscope. The W bending test was carried out under bending conditions of a ratio of a bending radius (R) to the thickness (t) was R/t=0, and a case where no cracking was observed was evaluated as "◎" (excellent), a case where no cracking was observed at R/t=1.0 was evaluated as "○" (good), and a case where cracking was observed at R/t=1.0 was evaluated as "x" (poor).

(Measurement of Conductivity of Product)

The conductivity of the product was determined by volume resistivity measurement using a double bridge in accordance with JIS H0505.

(Pressing Property)

The pressing was carried out by displacing a square punch having one side of 10 mm toward a die having a clearance of 0.005 mm at a rate of 2 mm/min while arranging the product between the punch and the die. The press fractured surface after pressing was observed with an optical microscope and the pressing property was evaluated at $L/L_0$ as shown in FIG. 1, in which $L_0$ is a width of the observed surface and L is the total length of a boundary between the sheared surface and the fractured surface. The total length L was calculated from a photograph of the observed surface using an image analysis software. The width $L_0$ of the observed surface was generally at least three times the thickness and measured at three positions. The observed surface was at a center of the press fractured surface in the width direction. In Table 3, the symbol "◎" indicates that the ratio $L/L_0$ was ($1<L/L_0\leq1.1$), and the symbol "○" indicates that the ratio was ($1.1<L/L_0\leq 1.3$), and the symbol "x" indicates that the ratio was ($L/L_0>1.3$).

Table 1 shows the alloy compositions, Table 2 shows the production conditions, and Table 3 shows the EBSD measurement results and the product characteristics of the rolling parallel cross section.

TABLE 1

| | Component (% by mass) | | | | |
|---|---|---|---|---|---|
| | Ni | Co | Si | Ni + Co | Added Element |
| Example 1 | 2.6 | 0.0 | 0.58 | 2.6 | 0.5Sn, 0.4Zn |
| Example 2 | 1.6 | 0.0 | 0.36 | 1.6 | 0.5Sn, 0.4Zn |
| Example 3 | 3.8 | 0.0 | 0.78 | 3.8 | 0.13Mn—0.1Mg |
| Example 4 | 4.8 | 0.0 | 1.10 | 4.8 | 0.5Sn, 0.4Zn |
| Example 5 | 0.3 | 0.0 | 0.25 | 0.3 | — |
| Example 6 | 3.8 | 0.0 | 0.62 | 3.8 | 0.13Mn—0.1Mg |
| Example 7 | 1.8 | 1.1 | 0.60 | 2.9 | 0.1Cr |
| Example 8 | 0.5 | 1.5 | 0.63 | 2.0 | 0.1Cr |
| Example 9 | 2.3 | 0.0 | 0.52 | 2.3 | 0.13Mg |
| Example 10 | 4.0 | 0.5 | 0.81 | 4.5 | 0.05Mg |
| Example 11 | 2.6 | 0.0 | 1.10 | 2.6 | 0.5Sn, 0.4Zn |
| Example 12 | 1.3 | 0.6 | 0.50 | 1.9 | — |
| Example 13 | 0.0 | 1.9 | 0.45 | 1.9 | 0.1Cr |
| Example 14 | 2.8 | 0.0 | 0.6 | 2.8 | 0.5Sn, 0.4Zn |

TABLE 1-continued

| | Component (% by mass) | | | | |
|---|---|---|---|---|---|
| | Ni | Co | Si | Ni + Co | Added Element |
| Example 15 | 2.8 | 0.0 | 0.6 | 2.8 | 0.5Sn, 0.5Zn |
| Example 16 | 2.8 | 0.0 | 0.6 | 2.8 | 0.5Sn, 0.6Zn |
| Example 17 | 2.8 | 0.0 | 0.6 | 2.8 | 0.5Sn, 0.7Zn |
| Example 18 | 2.8 | 0.0 | 0.6 | 2.8 | 0.5Sn, 0.8Zn |
| Example 19 | 2.8 | 0.0 | 0.6 | 2.8 | 0.5Sn, 0.9Zn |
| Example 20 | 2.8 | 0.0 | 0.6 | 2.8 | 0.5Sn, 0.10Zn |
| Example 21 | 2.8 | 0.0 | 0.6 | 2.8 | 0.5Sn, 0.11Zn |
| Comparative Example 1 | 2.8 | 0.0 | 0.6 | 2.8 | 0.5Sn, 0.12Zn |
| Comparative Example 2 | 2.8 | 0.0 | 0.6 | 2.8 | 0.5Sn, 0.13Zn |
| Comparative Example 3 | 2.8 | 0.0 | 0.6 | 2.8 | 0.5Sn, 0.14Zn |
| Comparative Example 4 | 2.8 | 0.0 | 0.6 | 2.8 | 0.5Sn, 0.15Zn |
| Comparative Example 5 | 2.8 | 0.0 | 0.6 | 2.8 | 0.5Sn, 0.16Zn |
| Comparative Example 6 | 2.8 | 0.0 | 0.6 | 2.8 | 0.5Sn, 0.16Zn |
| Comparative Example 7 | 2.8 | 0.0 | 0.6 | 2.8 | 0.5Sn, 0.18Zn |
| Comparative Example 8 | 2.8 | 0.0 | 0.6 | 2.8 | 0.5Sn, 0.19Zn |
| Comparative Example 9 | 3.1 | 1.2 | 0.6 | 4.3 | 0.5Sn, 0.20Zn |
| Comparative Example 10 | 2.8 | 0.0 | 0.6 | 2.8 | 0.5Sn, 0.21Zn |
| Comparative Example 11 | 2.8 | 0.0 | 0.6 | 2.8 | 0.5Sn, 0.22Zn |
| Comparative Example 12 | 2.8 | 0.0 | 0.6 | 2.8 | 0.5Sn, 0.24Zn |
| Comparative Example 13 | 4.5 | 0.7 | 1.1 | 5.2 | 0.1Cr |
| Comparative Example 14 | 3.2 | 0.0 | 1.6 | 3.2 | 0.1Cr |

TABLE 2

| | Product | Cold | Pre-annealing | | | Light Rolling | | Solutionizing | | | | Rolling 2 | Strain |
|---|---|---|---|---|---|---|---|---|---|---|---|---|---|
| | Thickness (mm) | Rolling Thickness (mm) | Temperature (° C.) | Time | Degree of Softening | Working Ratio (%) | Surface Roughness (μm) | Material Temperature | Temperature Rising Rate ° C./sec | Rolling 1 Working Ratio (%) | Aging Temperature (° C.) | Working Ratio (%) | Relief Temperature (° C.) |
| Example 1 | 0.08 | 0.10 | 600 | 1 min | 0.47 | 35 | 0.21 | 740 | 20 | 0 | 450 | 20 | 350 |
| Example 2 | 0.15 | 0.21 | 550 | 15 sec | 0.57 | 27 | 0.21 | 750 | 20 | 0 | 450 | 30 | 300 |
| Example 3 | 0.08 | 0.11 | 550 | 15 sec | 0.56 | 27 | 0.21 | 750 | 20 | 0 | 450 | 30 | Non |
| Example 4 | 0.08 | 0.11 | 550 | 15 sec | 0.56 | 27 | 0.21 | 750 | 20 | 0 | 450 | 30 | Non |
| Example 5 | 0.08 | 0.11 | 550 | 15 sec | 0.56 | 27 | 0.21 | 750 | 20 | 0 | 450 | 30 | Non |
| Example 6 | 0.04 | 0.05 | 550 | 15 sec | 0.54 | 27 | 0.21 | 700 | 20 | 25 | 430 | 0 | Non |
| Example 7 | 0.40 | 0.44 | 530 | 10 min | 0.41 | 32 | 0.21 | 850 | 20 | 0 | 450 | 10 | 400 |
| Example 8 | 0.08 | 0.10 | 400 | 1 min | 0.23 | 30 | 0.19 | 775 | 15 | 0 | 450 | 20 | 500 |
| Example 9 | 0.08 | 0.09 | 650 | 1 min | 0.75 | 32 | 0.21 | 780 | 15 | 0 | 450 | 15 | 350 |
| Example 10 | 0.12 | 0.20 | 540 | 1 min | 0.41 | 5 | 0.22 | 860 | 15 | 20 | 450 | 25 | 350 |
| Example 11 | 0.10 | 0.14 | 550 | 1 min | 0.45 | 48 | 0.31 | 780 | 25 | 10 | 500 | 20 | 350 |
| Example 12 | 0.12 | 0.15 | 550 | 1 min | 0.46 | 32 | 0.16 | 850 | 20 | 0 | 400 | 20 | 350 |
| Example 13 | 0.08 | 0.10 | 580 | 1 min | 0.47 | 30 | 0.39 | 850 | 15 | 0 | 450 | 20 | 350 |
| Example 14 | 0.08 | 0.10 | 570 | 1 min | 0.46 | 29 | 0.21 | 710 | 15 | 0 | 450 | 20 | 350 |
| Example 15 | 0.08 | 0.10 | 420 | 1 min | 0.31 | 27 | 0.25 | 880 | 15 | 0 | 450 | 20 | 350 |
| Example 16 | 0.08 | 0.10 | 550 | 15 sec | 0.43 | 30 | 0.23 | 775 | 12 | 0 | 450 | 20 | 350 |
| Example 17 | 0.08 | 0.10 | 550 | 15 sec | 0.45 | 29 | 0.20 | 775 | 27 | 0 | 450 | 20 | 350 |
| Example 18 | 0.08 | 0.11 | 550 | 15 sec | 0.56 | 25 | 0.25 | 775 | 20 | 5 | 450 | 20 | 350 |
| Example 19 | 0.08 | 0.19 | 550 | 15 sec | 0.44 | 25 | 0.23 | 750 | 20 | 47 | 450 | 20 | 350 |
| Example 20 | 0.08 | 0.08 | 550 | 15 sec | 0.46 | 25 | 0.22 | 750 | 20 | 0 | 450 | 5 | 350 |
| Example 21 | 0.08 | 0.15 | 550 | 15 sec | 0.45 | 25 | 0.21 | 750 | 20 | 0 | 450 | 47 | 350 |
| Comparative Example 1 | 0.08 | 0.10 | 350 | 15 sec | 0.18 | 25 | 0.23 | 775 | 20 | 0 | 450 | 20 | 350 |
| Comparative Example 2 | 0.08 | 0.10 | 700 | 15 sec | 0.82 | 25 | 0.25 | 800 | 20 | 0 | 450 | 20 | 350 |
| Comparative Example 3 | 0.08 | 0.10 | 550 | 15 sec | 0.49 | 2 | 0.22 | 800 | 20 | 0 | 450 | 20 | 350 |
| Comparative Example 4 | 0.08 | 0.10 | 550 | 15 sec | 0.45 | 53 | 0.21 | 800 | 20 | 0 | 450 | 20 | 350 |
| Comparative Example 5 | 0.08 | 0.10 | 550 | 15 sec | 0.43 | 30 | 0.12 | 750 | 20 | 0 | 450 | 20 | 350 |
| Comparative Example 6 | 0.08 | 0.10 | 550 | 15 sec | 0.43 | 30 | 0.42 | 750 | 20 | 0 | 450 | 20 | 350 |
| Comparative Example 7 | 0.08 | 0.10 | 550 | 15 sec | 0.49 | 30 | 0.22 | 680 | 20 | 0 | 450 | 20 | 350 |
| Comparative Example 8 | 0.08 | 0.10 | 550 | 15 sec | 0.46 | 30 | 0.22 | 910 | 20 | 0 | 450 | 20 | 350 |

TABLE 2-continued

| | Product Thickness (mm) | Cold Rolling Thickness (mm) | Pre-annealing Temperature (° C.) | Pre-annealing Time | Pre-annealing Degree of Softening | Light Rolling Working Ratio (%) | Light Rolling Surface Roughness (μm) | Solutionizing Material Temperature | Solutionizing Temperature Rising Rate ° C./sec | Rolling 1 Working Ratio (%) | Aging Temperature (° C.) | Rolling 2 Working Ratio (%) | Strain Relief Temperature (° C.) |
|---|---|---|---|---|---|---|---|---|---|---|---|---|---|
| Comparative Example 9 | 0.08 | 0.10 | 550 | 15 sec | 0.44 | 30 | 0.22 | 775 | 7 | 0 | 450 | 20 | 350 |
| Comparative Example 10 | 0.08 | 0.10 | 550 | 15 sec | 0.45 | 30 | 0.22 | 775 | 35 | 0 | 450 | 20 | 350 |
| Comparative Example 11 | 0.08 | 0.21 | 550 | 15 sec | 0.45 | 30 | 0.22 | 775 | 20 | 52 | 450 | 20 | 350 |
| Comparative Example 12 | 0.08 | 0.17 | 550 | 15 sec | 0.45 | 30 | 0.22 | 775 | 20 | 0 | 450 | 53 | 350 |
| Comparative Example 13 | 0.08 | 0.10 | 550 | 15 sec | 0.45 | 30 | 0.22 | 775 | 20 | 0 | 450 | 20 | 350 |
| Comparative Example 14 | 0.08 | 0.09 | 550 | 15 sec | 0.45 | 30 | 0.22 | 775 | 20 | 0 | 450 | 15 | 350 |

TABLE 3

| | Crystal Grain Size (a) Grain Size of Cube Orientation μm | Crystal Grain Size (b) Average Grain Size μm | Crystal Grain Size (a)/(b) | Area Ratio of Cube Grain (%) | Cube Orientation $I_{(200)}/I_{O(200)}$ | Product Characteristics Tensile Strength (Mpa) | Product Characteristics Conductivity (% IACS) | Product Characteristics Bending Workability ◎, O, X | Product Characteristics Pressing Property ◎, O, X |
|---|---|---|---|---|---|---|---|---|---|
| Example 1 | 9.0 | 7.3 | 1.23 | 6.0 | 2.2 | 830 | 39 | ◎ | ◎ |
| Example 2 | 12.3 | 13.0 | 0.95 | 5.4 | 2.4 | 700 | 58 | ◎ | ◎ |
| Example 3 | 8.5 | 8.7 | 0.98 | 5.1 | 2.4 | 750 | 42 | ◎ | ◎ |
| Example 4 | 8.3 | 9.0 | 0.92 | 6.3 | 2.3 | 980 | 35 | O | ◎ |
| Example 5 | 7.2 | 6.2 | 1.16 | 6.7 | 3.5 | 650 | 78 | ◎ | ◎ |
| Example 6 | 2.2 | 2.4 | 0.92 | 6.2 | 1.6 | 780 | 37 | ◎ | ◎ |
| Example 7 | 15.0 | 12.0 | 1.25 | 6.2 | 3.6 | 810 | 51 | ◎ | ◎ |
| Example 8 | 8.7 | 10.1 | 0.86 | 3.4 | 1.2 | 750 | 64 | O | ◎ |
| Example 9 | 9.1 | 9.5 | 0.96 | 3.2 | 1.1 | 713 | 50 | O | ◎ |
| Example 10 | 18.2 | 15.2 | 1.20 | 4.2 | 1.1 | 1020 | 34 | O | ◎ |
| Example 11 | 9.2 | 8.4 | 1.10 | 6.0 | 1.3 | 780 | 41 | O | ◎ |
| Example 12 | 19.1 | 13.1 | 1.46 | 8.2 | 3.5 | 650 | 62 | ◎ | O |
| Example 13 | 18.1 | 20.0 | 0.91 | 9.8 | 4.0 | 680 | 67 | ◎ | O |
| Example 14 | 2.5 | 3.1 | 0.81 | 6.5 | 1.1 | 740 | 41 | O | ◎ |
| Example 15 | 18.0 | 15.0 | 1.20 | 6.9 | 4.8 | 760 | 38 | ◎ | O |
| Example 16 | 18.0 | 12.5 | 1.44 | 8.2 | 2.6 | 750 | 37 | ◎ | O |
| Example 17 | 15.0 | 12.0 | 1.25 | 8.3 | 3.4 | 750 | 38 | ◎ | O |
| Example 18 | 12.0 | 13.0 | 0.92 | 8.1 | 3.2 | 750 | 39 | ◎ | ◎ |
| Example 19 | 8.0 | 7.7 | 1.04 | 2.5 | 0.8 | 750 | 39 | O | ◎ |
| Example 20 | 7.0 | 5.9 | 1.19 | 6.0 | 2.3 | 750 | 38 | ◎ | ◎ |
| Example 21 | 8.0 | 7.5 | 1.07 | 4.0 | 2.2 | 760 | 37 | O | ◎ |
| Comparative Example 1 | 1.5 | 1.2 | 1.25 | 6.2 | 0.6 | 800 | 37 | X | X |
| Comparative Example 2 | 1.1 | 1.2 | 0.92 | 6.3 | 0.1 | 810 | 38 | X | X |
| Comparative Example 3 | 1.6 | 1.3 | 1.23 | 8.1 | 0.7 | 820 | 41 | X | ◎ |
| Comparative Example 4 | 1.8 | 1.2 | 1.50 | 7.2 | 0.6 | 811 | 42 | X | ◎ |
| Comparative Example 5 | 20.1 | 12.0 | 1.68 | 6.2 | 2.2 | 815 | 41 | ◎ | X |
| Comparative Example 6 | 15.0 | 12.0 | 1.25 | 12.0 | 2.3 | 832 | 42 | ◎ | X |
| Comparative Example 7 | 1.5 | 1.3 | 1.15 | 2.1 | 0.9 | 650 | 38 | X | ◎ |
| Comparative Example 8 | 22.0 | 20.0 | 1.10 | 8.0 | 6.2 | 820 | 39 | ◎ | X |
| Comparative Example 9 | 25.0 | 20.0 | 1.25 | 7.5 | 4.0 | 835 | 41 | ◎ | X |
| Comparative Example 10 | 12.0 | 17.0 | 0.71 | 6.3 | 2.5 | 820 | 39 | ◎ | X |
| Comparative Example 11 | 8.5 | 7.5 | 1.13 | 6.8 | 2.2 | 810 | 38 | X | ◎ |
| Comparative Example 12 | 8.9 | 8.9 | 1.00 | 7.3 | 2.6 | 800 | 38.5 | X | ◎ |
| Comparative Example 13 | 8.9 | 10.1 | 0.88 | 7.8 | 2.4 | 810 | 39 | X | ◎ |

TABLE 3-continued

| | Crystal Grain Size | | | | | Product Characteristics | | | |
|---|---|---|---|---|---|---|---|---|---|
| | (a) Grain Size of Cube Orientation μm | (b) Average Grain Size μm | (a)/(b) | Area Ratio of Cube Grain (%) | Cube Orientation $I_{(200)}/I_{O(200)}$ | Tensile Strength (Mpa) | Conductivity (% IACS) | Bending Workability ◎, O, X | Pressing Property ◎, O, X |
| Comparative Example 14 | 9.1 | 10.0 | 0.91 | 3.2 | 1.5 | 811 | 39 | X | ◎ |

What is claimed is:

1. A copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material has a surface satisfying the relationship: $1.0 \leq I_{(200)}/I_{0(200)} \leq 5.0$;

wherein an area ratio of Cube orientation {100} <001> is from 2 to 10% in EBSD measurement of a rolling parallel cross section; and wherein a ratio: (an average crystal grain size of Cube orientation {100} <001> of the rolling parallel cross section)/(an average crystal grain size of the rolling parallel cross section) is from 0.75 to 1.5.

2. The copper alloy strip according to claim 1, wherein the average crystal grain size of {100} <001> of the rolling parallel cross section is from 2 to 20 μm.

3. The copper alloy strip according to claim 1, wherein the copper alloy strip contains one or more of Sn, Zn, Mg, Cr and Mn in a total amount of from 0.005 to 2.0% by mass.

4. The copper alloy strip according to claim 2, wherein the copper alloy strip contains one or more of Sn, Zn, Mg, Cr and Mn in a total amount of from 0.005 to 2.0% by mass.

5. The copper alloy strip according to claim 1, wherein the copper alloy has a pressing property of $1 < L/L_0 \leq 1.3$, in which $L_0$ is a width of the observed surface and L is the total length of a boundary between the sheared surface and the fractured surface.

6. A copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material has a surface satisfying the relationship: $1.0 \leq I_{(200)}/I_{0(200)} \leq 5.0$;

wherein an area ratio of Cube orientation {100} <001> is from 2 to 10% in EBSD measurement of a rolling parallel cross section; and wherein a ratio: (an average crystal grain size of Cube orientation {100} <001> of the rolling parallel cross section)/(an average crystal grain size of the rolling parallel cross section) is from 0.75 to 1.5, and wherein the copper alloy strip has an observed surface, a sheared surface and a fractured surface, and has a pressing property of $1 < L/L_0 \leq 1.1$, in which $L_0$ is a width of the observed surface and L is the total length of a boundary between the sheared surface and the fractured surface.

7. The copper alloy strip according to claim 1, wherein the copper alloy has an observed surface, a sheared surface and a fractured surface, the copper alloy having a pressing property of $1 < L/L_0 \leq 1.3$, in which $L_0$ is a width of the observed surface and L is the total length of a boundary between the sheared surface and the fractured surface.

* * * * *